US008079631B2

(12) United States Patent
Higgins et al.

(10) Patent No.: US 8,079,631 B2
(45) Date of Patent: Dec. 20, 2011

(54) METHOD AND SYSTEM FOR GUIDING A DRIVE ROD IN A DOOR AFTER AN IMPACT TO THE DOOR

(75) Inventors: Christopher M. Higgins, Ypsilanti, MI (US); Nathaniel P. Jordan, Ann Arbor, MI (US); Jessica A. Riffe, Pickney, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 12/621,398

(22) Filed: Nov. 18, 2009

(65) Prior Publication Data

US 2011/0115252 A1 May 19, 2011

(51) Int. Cl.
*E05C 9/10* (2006.01)

(52) U.S. Cl. ..... 296/146.1; 292/259 A; 296/187.12

(58) Field of Classification Search ..... 292/53, 292/86, 259 A, DIG. 23, DIG. 41; 296/146.1, 296/187.12
See application file for complete search history.

(56) References Cited

U.S. PATENT DOCUMENTS

| | | | | |
|---|---|---|---|---|
| 3,596,956 | A | | 8/1971 | Yoshie |
| 4,466,645 | A | | 8/1984 | Kobayashi |
| 4,497,514 | A | | 2/1985 | Moriya et al. |
| 4,580,821 | A | | 4/1986 | Genord, Jr. et al. |
| 4,775,176 | A | | 10/1988 | Ikeda |
| 5,058,938 | A | | 10/1991 | Doring et al. |
| 5,069,493 | A | * | 12/1991 | Mochida et al. ..... 292/336.3 |
| 5,154,457 | A | | 10/1992 | Watanabe |
| 5,253,906 | A | | 10/1993 | Rogers, Jr. et al. |
| 5,265,920 | A | | 11/1993 | Kaup et al. |
| 5,431,462 | A | * | 7/1995 | Lignell ..... 292/336.3 |
| 5,492,379 | A | * | 2/1996 | Staser et al. ..... 292/336.3 |
| 5,584,516 | A | | 12/1996 | Cetnar |
| 5,782,114 | A | | 7/1998 | Zeus et al. |
| 5,855,400 | A | | 1/1999 | Ohhashi et al. |
| 6,065,797 | A | | 5/2000 | Shirasaka |
| 6,155,618 | A | | 12/2000 | Ichinose |
| 6,168,216 | B1 | | 1/2001 | Nakajima et al. |
| 6,419,286 | B1 | | 7/2002 | Szablewski |
| 6,428,058 | B1 | | 8/2002 | Graute |
| 6,464,270 | B1 | | 10/2002 | Sloan et al. |

(Continued)

FOREIGN PATENT DOCUMENTS

| | | |
|---|---|---|
| EP | 0013255 | 7/1980 |

(Continued)

*Primary Examiner* — Glenn Dayoan
*Assistant Examiner* — Paul Chenevert
(74) *Attorney, Agent, or Firm* — Snell & Wilmer L.L.P.

(57) ABSTRACT

A method and system for guiding a drive rod in a door after an impact to the door. An automobile having a door with a door handle, a drive rod, a latching system, a striker, and a drive rod guiding member. The drive rod guiding member can be positioned adjacent to the drive rod. Upon impact to the door, the drive rod can be disengaged from the door handle or the latching system. The drive rod guiding member guides the drive rod away from the door handle or the latching system. By guiding the drive rod away the door handle or the latching system, the drive rod guiding member can prevent the drive rod from re-engaging with the door handle or the latching system. This maintains the door in the closed position instead of the open position.

20 Claims, 8 Drawing Sheets

U.S. PATENT DOCUMENTS

| | | | | |
|---|---|---|---|---|
| 6,519,986 | B2 | 2/2003 | Wicker | |
| 6,685,239 | B2 | 2/2004 | Yamauchi et al. | |
| 6,779,820 | B2 | 8/2004 | Ogino | |
| 6,810,699 | B2 | 11/2004 | Nagy | |
| 6,880,866 | B2 | 4/2005 | Tomaszewski et al. | |
| 6,880,867 | B2 * | 4/2005 | Schoen et al. | 292/216 |
| 6,929,293 | B2 | 8/2005 | Tonges | |
| 7,128,349 | B2 | 10/2006 | Bendel et al. | |
| 7,159,907 | B2 | 1/2007 | Song | |
| 7,224,259 | B2 | 5/2007 | Belmond et al. | |
| 7,303,224 | B2 * | 12/2007 | Kim | 296/76 |
| 7,380,845 | B2 | 6/2008 | Suzumura et al. | |
| 7,789,455 | B2 * | 9/2010 | Hall et al. | 296/187.05 |
| 2003/0160462 | A1 | 8/2003 | Tonges | |
| 2004/0201229 | A1 | 10/2004 | Shabana et al. | |
| 2005/0012345 | A1 | 1/2005 | Saitoh | |
| 2005/0146147 | A1 | 7/2005 | Niskanen et al. | |
| 2006/0103145 | A1 | 5/2006 | Ottolini et al. | |
| 2006/0175845 | A1 | 8/2006 | Arabia, Jr. et al. | |
| 2006/0261602 | A1 | 11/2006 | Jankowski et al. | |
| 2007/0029835 | A1 * | 2/2007 | Herline et al. | 296/146.1 |
| 2007/0069525 | A1 | 3/2007 | Ghannam | |
| 2007/0158954 | A1 | 7/2007 | Warmke et al. | |
| 2007/0182165 | A1 | 8/2007 | Yoshikuwa et al. | |
| 2008/0185850 | A1 * | 8/2008 | Takaya et al. | 292/336.3 |
| 2008/0277947 | A1 | 11/2008 | Costigan | |
| 2009/0064591 | A1 * | 3/2009 | Keller et al. | 49/358 |
| 2009/0224569 | A1 * | 9/2009 | Lagrut | 296/146.1 |
| 2010/0019512 | A1 * | 1/2010 | Gschweng et al. | 292/217 |
| 2010/0109350 | A1 * | 5/2010 | Gschweng et al. | 292/196 |
| 2011/0062747 | A1 * | 3/2011 | Teramoto et al. | 296/146.1 |
| 2011/0115251 | A1 * | 5/2011 | Jordan et al. | 296/146.1 |

FOREIGN PATENT DOCUMENTS

| | | | |
|---|---|---|---|
| GB | 2275727 | | 9/1994 |
| GB | 2361675 | A * | 10/2001 |
| JP | 2001-262901 | | 9/2001 |
| JP | 2009024328 | | 2/2009 |
| KR | 2001087451 | A * | 9/2001 |
| KR | 765836 | B1 * | 10/2007 |
| WO | WO 82/00848 | | 3/1982 |

* cited by examiner

METHOD AND SYSTEM FOR GUIDING A DRIVE ROD IN A DOOR AFTER AN IMPACT TO THE DOOR

BACKGROUND

1. Field of the Invention

The present invention relates to a method and system for guiding a drive rod in a door after an impact to the door.

2. Description of the Related Art

A conventional automobile includes a conventional door that opens in an outward direction. The conventional door is opened using a handle, a drive rod, a latching system, and a striker. Actuation of the handle moves the drive rod, which in turn controls the latching system to engage or disengage from the striker. During an accident where there is an impact to the door, the door can be deformed and compressed. The deformation and compression move the latching system closer to the handle such that the drive rod permanently controls the latching system to disengage from the striker, causing the door to be in a permanent or semi-permanent open position. Having the door be left permanently or semi-permanently open is undesirable.

Thus, there is a need for a method and system for guiding a drive rod in a door after an impact to the door.

SUMMARY

The present invention is a method and system for guiding a drive rod in a door after an impact to the door. The present invention includes an automobile having a door with a door handle, a drive rod, a latching system, a striker, and a drive rod guiding member. The drive rod guiding member can be positioned adjacent to the drive rod. Upon impact to the door, the drive rod can be disengaged from the door handle or the latching system. The drive rod guiding member guides the drive rod away from the door handle or the latching system. By guiding the drive rod away the door handle or the latching system, the drive rod guiding member can prevent the drive rod from re-engaging with the door handle or the latching system. This maintains the door in the closed position instead of the open position.

In one embodiment, the present invention is a door latch system including a door, a door handle located on the door, a latch release unit located in the door, a drive rod engaged with the door handle and the latch release unit, and a drive rod guiding member located in the door, wherein upon impact to the door causing deformation of the door, the drive rod disengages from the door handle or the latch release unit and the drive rod guiding member guides the drive rod away from the door handle or the latch release unit.

In another embodiment, the present invention is an automobile including a frame, a striker located in the frame, and a door connected to the frame and selectively engaged with the striker. The door can include a latch unit selectively engaged with the striker, a latch release unit connected to the latch unit, wherein actuation of the latch release unit controls the engagement of the latch unit with the striker, a drive rod engaged to the latch release unit, a door handle engaged to the drive rod wherein the drive rod actuates the latch release unit based on a movement of the handle, and a drive rod guiding member wherein upon impact to the door causing deformation of the door, the drive rod disengages from the door handle or the latch release unit and the drive rod guiding member guides the drive rod away from the door handle or the latch release unit.

In yet another embodiment, the present invention is a method for guiding a drive rod in a door after an impact to the door including disengaging the drive rod from a door handle or a latch release unit, and guiding the drive rod away from the door handle or the latch release unit.

BRIEF DESCRIPTION OF THE DRAWINGS

The features, obstacles, and advantages of the present invention will become more apparent from the detailed description set forth below when taken in conjunction with the drawings, wherein.

DETAILED DESCRIPTION

Apparatus, systems and methods that implement the embodiments of the various features of the present invention will now be described with reference to the drawings. The drawings and the associated descriptions are provided to illustrate some embodiments of the present invention and not to limit the scope of the present invention. Throughout the drawings, reference numbers are re-used to indicate correspondence between referenced elements.

Figure 1:
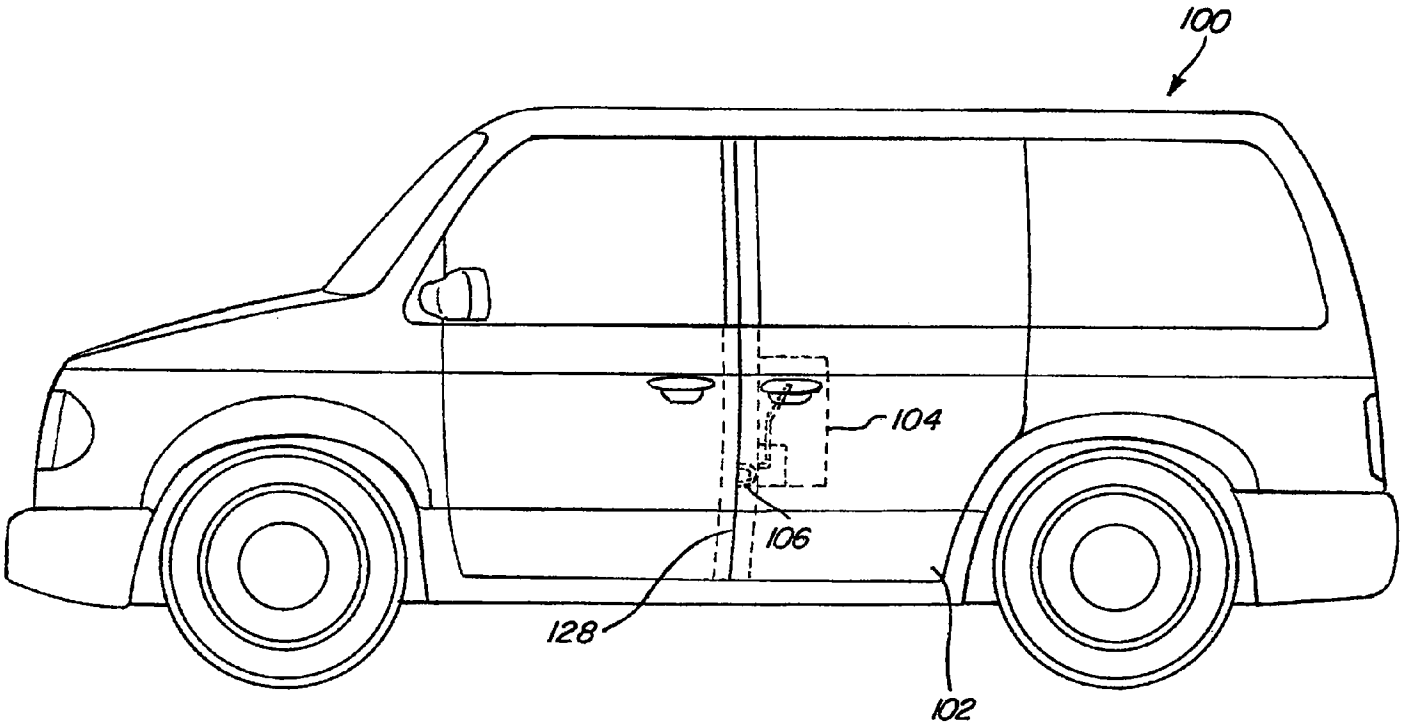
FIG. 1 depicts an automobile including a latching system according to an embodiment of the present invention.

As seen in FIG. 1, a transportation device such as an automobile 100 includes a door 102, a door lock assembly 104, a striker 106, and a frame 128. The automobile 100 can be, for example, a car, a hybrid car, a car with an internal combustion engine, or any other type of vehicle which can be used to transport objects. The striker 106 is connected to the frame 128 of the automobile 100. The door 102 includes the door lock assembly 104, which is selectively engaged to the striker 106. The door 102 can be, for example, a sliding door, or a hinged door. When the door lock assembly 104 is engaged with the striker 106, the door 102 is secured to the frame 128. When the door lock assembly 104 is not engaged with the striker 106, the door 102 can be opened.

Figure 2:
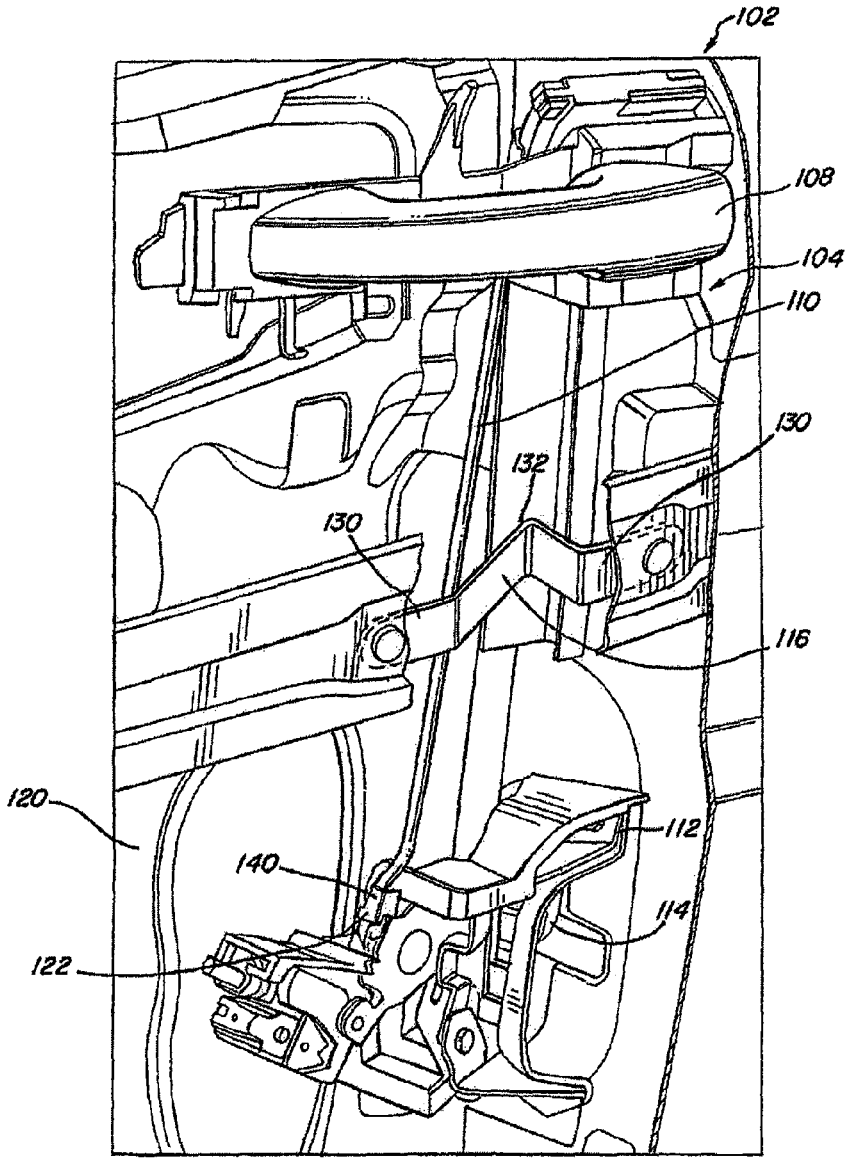
FIG. 2 is a perspective view of a door without an outer panel according to an embodiment of the present invention.
Figure 3:
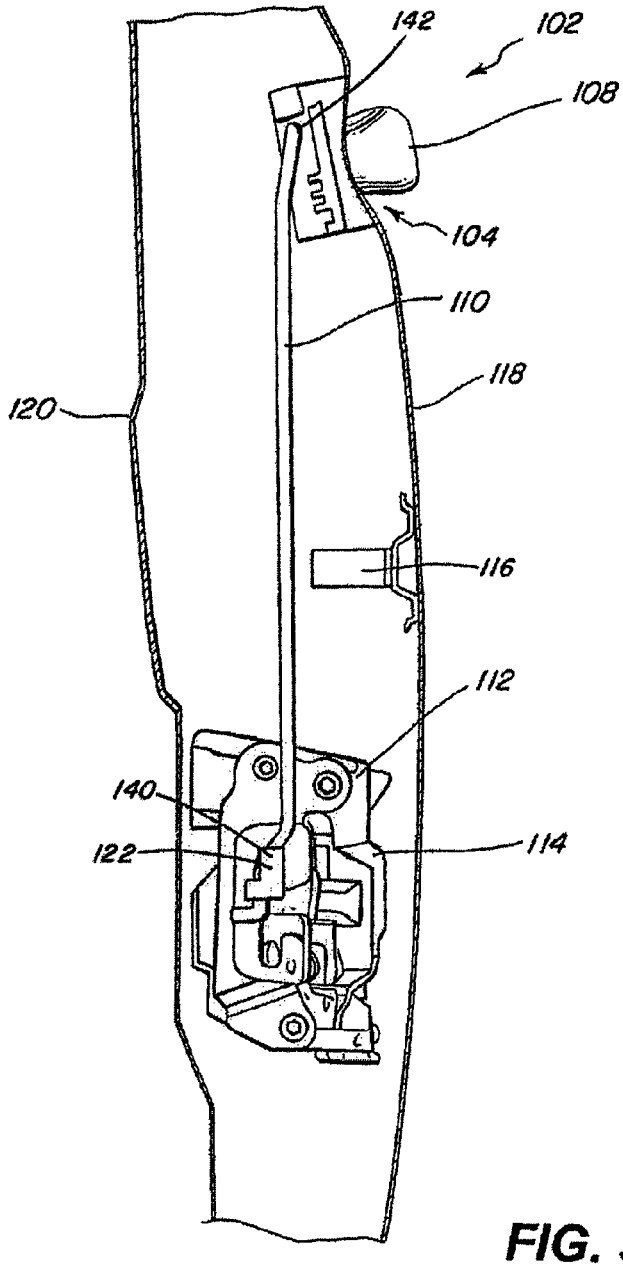
FIG. 3 is a side view of a door according to an embodiment of the present invention.

The door lock assembly 104 can be seen, for example in FIGS. 2 and 3. FIG. 2 is a perspective view of the door 102 without an outer panel, while FIG. 3 is a side view of the door 102. The door 102 in FIG. 3 includes a first panel 118 and a second panel 120. In FIG. 2, only the second panel 120 is shown. The first panel 118 can be, for example, an outer panel, while the second panel 120 can be, for example, an inner panel.

In FIGS. 2 and 3, the door lock assembly 104 can include a door handle 108, a drive rod 110, a drive rod guiding member 116 and/or a latching system 112. The door handle 108 is connected to the first panel 118, and is engaged with the drive rod 110. The drive rod 110 can be engaged with the door handle 108, for example, at an engagement point 142. The drive rod 110 is engaged to the latching system 112 while the latching system 112 is connected to the striker 106 (FIG. 1). The drive rod 110 can be engaged to the latching system 112, for example, at an engagement point 140.

The latching system 112 can be located in the door 102 and can be between, for example, the first panel 118 and/or the second panel 120. In one embodiment, the latching system 112 is connected to the second panel 120. The latching system 112 can include, for example, a latch release unit 122 and a latch unit 114. The latch release unit 122 and the latch unit 114 can be separate units or the same unit. In addition, the latch release unit 122 and the latch unit 114 can be integrated together. Furthermore, in one embodiment, the drive rod 110, the latch release unit 122, and/or the latch unit 114 can form a bell crank.

The drive rod guiding member 116 is located in the door 102 and is positioned adjacent to the drive rod 110. In FIG. 2, the drive rod guiding member 116 can include, for example, an attachment portion 130, and a guiding protrusion 132. The guiding protrusion, for example, can have a triangular shape. However, the drive rod guiding member 116 including the guiding protrusion 132 can be formed from any shape or size such that it is capable of guiding the drive rod 110 away from the door handle 108 and/or the latching system 112. The drive rod guiding member 116 can be formed, for example, from steel, plastic, aluminum, an alloy, or any other suitable material with sufficient rigidity to guide the drive rod 110 away from the door handle 108 and/or the latching system 112.

In one embodiment, the drive rod guiding member 116 can be connected to the first panel 118. The drive rod guiding member 116 can also be located on the second panel 120. In another embodiment, the drive rod guiding member 116 can be located on or adjacent to the latching system 112. For example, the drive rod guiding member 116 can be integrated into the latching system 112. In yet another embodiment, the drive rod guiding member 116 can be located on or adjacent to the door handle 108. For example, the drive rod guiding member 116 can be integrated into the door handle 108.

Generally, the drive rod guiding member 116 can be located anywhere in or on the door 102, including anywhere on the first panel 118 and/or the second panel 120, such that it can guide or contact the drive rod 110 after the drive rod 110 disengages from the door handle 108 and/or the latching system 112. The drive rod 110 can disengage from the door handle 108 and/or the latching system 112 when the door 102 is impacted by an object.

The drive rod guiding member 116 can contact the drive rod 110 at any point along the drive rod 110 which is sufficient to guide the drive rod 110 from the door handle 108 and/or the latching system 112. For example, the drive rod guiding member 116 can contact the drive rod 110 at a point close to the handle 108, a point close to the latching system 112, and/or a point between the handle 108 and the latching system 112. In one embodiment the drive rod guiding member 116 can contact the drive rod 110 at a point close to the door handle 108 when the drive rod 110 disengages from the door handle 108.

In another embodiment, the drive rod guiding member 116 can contact the drive rod 110 at a point close to the latching system 112 when the drive rod 110 disengages from the latching system 112.

In operation, the door handle 108 can be actuated to move the drive rod 110. The movement of the drive rod 110 moves the latch release unit 122, and the latch release unit 122 moves the latch unit 114. The latch unit 114 can be moved to engage with the striker 106 or disengage with the striker 106. The drive rod guiding member 116 ensures that the drive rod 110 remains disengaged from the latching system 112 after impact to the automobile 100 and/or the door 102.

In one embodiment, upon impact to the automobile 100 and/or the door 102, the drive rod 110 disengages from the door handle 108 and/or the latching system 112. The drive rod guiding member 116 contacts the drive rod 110 and guides the drive rod 110 away from the door handle 108 and/or the latching system 112. For example, the drive rod guiding member 116 can guide the drive rod 110 away from the engagement point 140 when the drive rod 110 is disengaged from the latching system 112. The drive rod guiding member 116 can guide the drive rod 110 away from the engagement point 142 when the drive rod 110 is disengaged from the door handle 108. By guiding the drive rod 110 away from the engagement point 142, the door handle 108, the engagement point 140, and/or the latching system 112, the drive rod guiding member 116 prevents the drive rod 110 from re-engaging with the door handle 108 and/or the latching system 112.

Since the drive rod 110 is disengaged from the latching system 112 and/or the door handle 108, the drive rod 110 will not cause the latching system 112 to disengage from the striker 106. This is advantageous when the door 102 deforms and/or compresses such that the door handle 108 is closer to the latching system 112. The reduced distance may cause the drive rod 110 to force the latching system 112 to disengage from the striker 106 in a conventional door. This can simulate, for example, an actuation of the door handle 108, and lead to the opening of the door. However, since the drive rod 110 is disengaged from the door handle 108 and/or the latching system 112 in the present invention, the drive rod 110 will not cause the latching system 112 to disengage from the striker 106. This can prevent the door 102 from undesirably opening during or after an accident. This can improve the safety to the occupants within the automobile 100 and/or prevent further damage to the automobile 100.

Similarly, if the drive rod 110 is disconnected from the latching system 112, any actuations of the door handle 108 will only move the drive rod 110 without causing the latching system 112 to disengage from the striker 106. Since the movement of the drive rod 110 does not affect the latching system 112, it does not cause the latching system 112 to disengage from the striker 106. This can prevent the door 102 from undesirably opening during or after an accident, for example, through unintended actuations of the door handle 108.

FIGS. 4-13 depict simulations of the door 102 prior to, during, and after an impact with an object 124. The object 124 can be mounted, for example, to an object 126. The object 124 can protrude from the object 126. The objects 124 and/or 126 can simulate an impact with real life objects such as another automobile, a wall, a tree, or any other object which can cause damage to the door 102.

Figure 4:
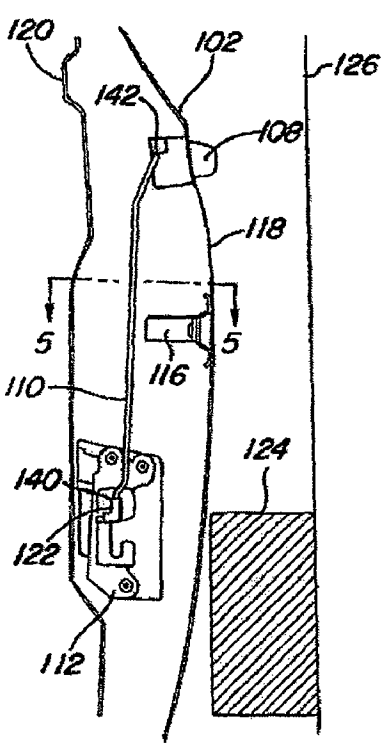
FIG. 4 is a side view of a door prior to an impact with an object according to an embodiment of the present invention.
Figure 5A:
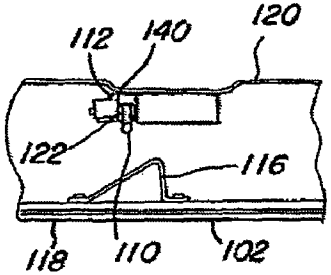
FIG. 5A is a top-down view of a door prior to an impact with an object wherein a drive rod guiding member is coupled to a first panel of the door, according to an embodiment of the present invention.
Figure 5B:
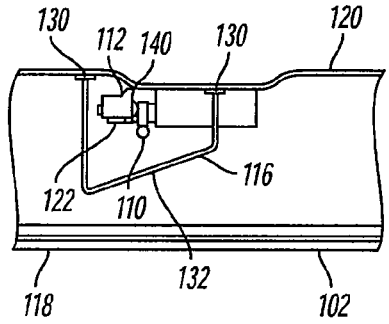
FIG. 5B is a top-down view of a door prior to an impact with an object wherein a drive rod guiding member is coupled to a second panel of the door, according to an alternative embodiment of the present invention.

FIGS. 4, 5A and 5B depict the door 102 prior to the impact with the object 124. FIG. 5A is a top-down view of FIG. 4 along the line 5-5 showing the drive rod guiding member 116 coupled to a first panel 118 of the door 102. See also FIG. 5B showing the drive rod guiding member 116 coupled to a second panel 120 of the door 102. As can be seen in FIG. 4, the drive rod 110 is engaged with the door handle 108 and the latching system 112. The drive rod guiding member 116, for example, has not impacted the drive rod 110. Thus, actuating the door handle 108 can cause the latching system 112 to be disengaged with the striker 106 (FIG. 1).

Figure 6A:
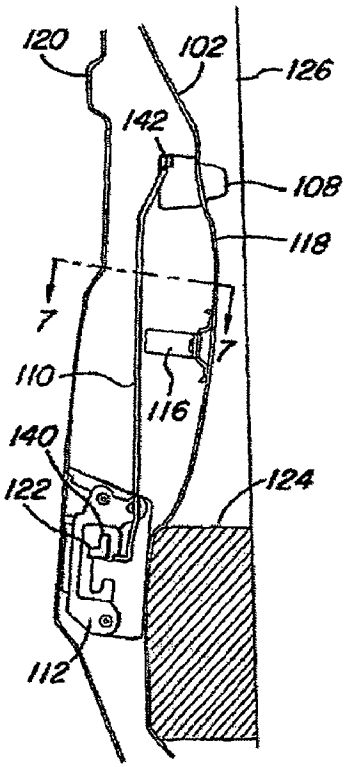
FIG. 6A is a side view of a door during an impact with an object wherein a drive rod separates from a latch release unit, according to an embodiment of the present invention.
Figure 7:
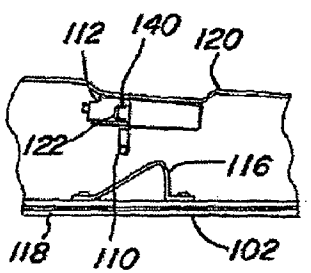
FIG. 7 is a top-down view of a door during an impact with an object according to an embodiment of the present invention.

FIGS. 6A and 7 depict the door 102 immediately after impact with the object 124.

Figure 6B:
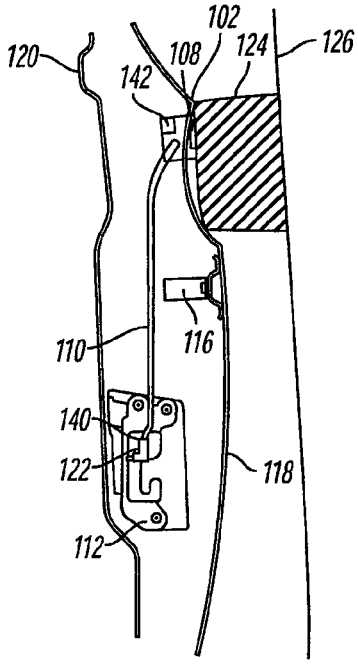
FIG. 6B is a side view of a door during an impact with an object wherein a drive rod separates from a door handle, according to an alternative embodiment of the present invention.

FIG. 7 is a top-down view of FIG. 6A along the line 7-7. The first panel 118 begins to deform due to the impact with the object 124. The deformation of the first panel 118 causes the latching system 112 to move closer to the second panel 120. The deformation of the first panel 118 can also cause the latching system 112 to move closer to the door handle 108. The drive rod 110 disengages from the latching system 112. For example, the drive rod 110 can separate from the latch release unit 122 in the latching system 112. In one embodiment, the drive rod 110 can separate from the latching system 112 at the engagement point 140, for example, from inertia and/or the movement of the latching system 112. See also FIG. 6B showing that the drive rod 110 can separate from the door handle 108, for example, at the engagement point 142.

Figure 8:
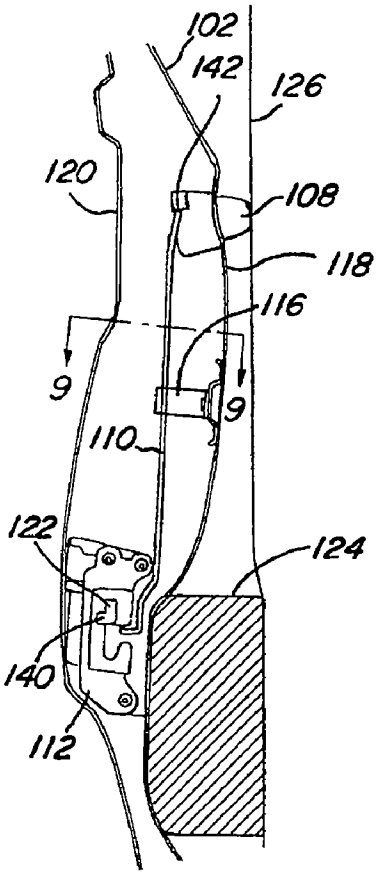
FIG. 8 is a side view of a door during an impact with an object according to an embodiment of the present invention.
Figure 9:
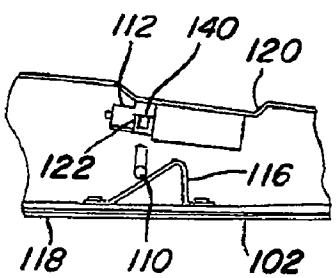
FIG. 9 is a top-down view of a door during an impact with an object according to an embodiment of the present invention.

FIGS. 8 and 9 depict the door 102 with greater deformation from the impact with the object 124. FIG. 9 is a top-down view of FIG. 8 along the line 9-9. As can be seen, the drive rod 110 moves or swings away from the latching system 112. The drive rod 110 can move or swing due to the inertia, and/or the movement of the latching system 112 from to the deformation of the first door panel 118 and/or the second door panel 120. The drive rod 110 moves or swings such that it contacts the drive rod guiding member 116.

Figure 10:
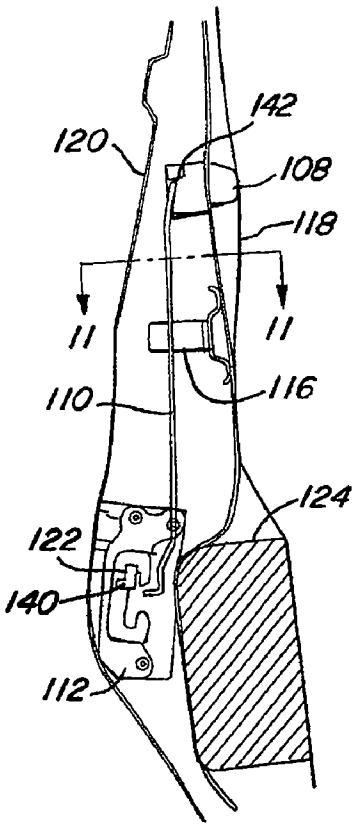
FIG. 10 is a side view of a door during an impact with an object according to an embodiment of the present invention.
Figure 11:
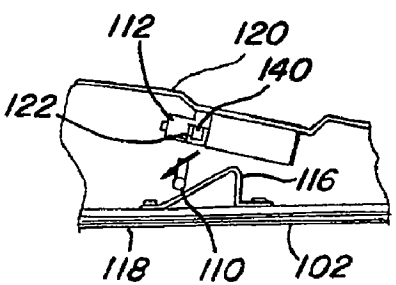
FIG. 11 is a top-down view of a door during an impact with an object according to an embodiment of the present invention.

FIGS. 10 and 11 depict the door 102 at a time after FIGS. 8 and 9. FIG. 11 is a top-down view of FIG. 10 along the line 11-11. As can be seen, the drive rod guiding member 116 guides the drive rod 110 away from the latching system 112. For example, the drive rod guiding member 116 can guide the drive rod 110 away from the engagement point 140 in the latching system 112.

Figure 13:
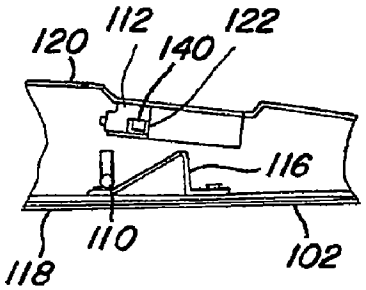
FIG. 13 is a top-down view of a door after an impact with an object according to an embodiment of the present invention.
Figure 12:
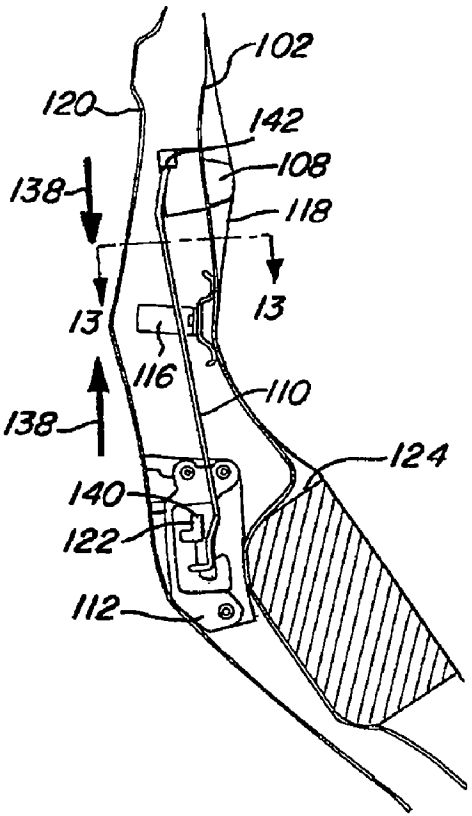
FIG. 12 is a side view of a door after an impact with an object according to an embodiment of the present invention.

FIGS. 12 and 13 depict the door 102 after the door 102 has completed its deformation from its impact with the object 124. FIG. 13 is a top-down view of FIG. 12 along the line 13-13. As can be seen, the door 102 has suffered compression along the arrows 138. The door handle 108 is now closer to the latching system 112. However, the drive rod guiding member 116 prevents the drive rod 110 from re-engaging with the latching system 112. In a conventional door 102, the compression along the arrows 138 could cause the drive rod 110 to force the latching system 112 to disengage from the striker 106. However, in the present invention, the drive rod 110 is prevented from re-engaging with the latching system 112 since it is guided away from the engagement point 140. Furthermore, the drive rod 110 does not actuate the latch release unit 122 and/or the latch unit 114 in the latching system 112 due to the compression along the arrows 138. In addition, actuation of the door handle 108 will not actuate the latch release unit 122 and/or the latch unit 114 in the latching system 112 since the drive rod 110 is disengaged from the latching system 112.

Figure 14:
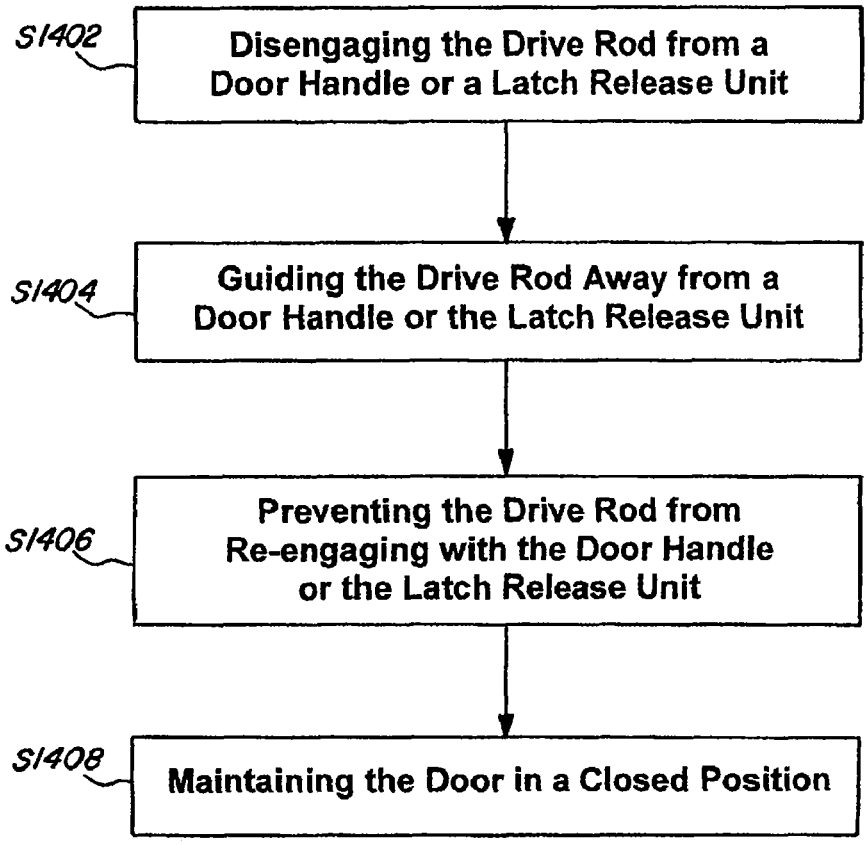
FIG. 14 is a flow chart for a process according to an embodiment of the present invention.

In one embodiment, the present invention is a process as disclosed in FIG. 14. In Step S1402, the drive rod is disengaged from a door handle or a latch release unit. For example, the drive rod 110 can disengage from the door handle 108 or the latch release unit 122. In Step S1404, the drive rod is guided away from the door handle or the latch release unit. For example, the drive rod guiding member 116 guides the drive rod 110 away from the door handle 108 or the latch release unit 122. In Step S1406, the drive rod is prevented from re-engaging with the door handle or the latch release unit. For example, the drive rod guiding member 116 guides the drive rod 110 to a location where the drive rod 110 is prevented from re-engaging with the door handle 108 or the latch release unit 122. In Step S1408, the door is maintained in a closed position. For example, the door 102 is maintained in a closed position even when the door handle 108 is actuated.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A door latch system comprising:
a door;
a door handle located on the door;
a latch release unit located in the door;
a drive rod engaged with the door handle and the latch release unit; and
a drive rod guiding member located in the door and disengaged from the drive rod;
wherein upon impact to the door causing deformation of the door, the drive rod disengages from the door handle or the latch release unit; and
wherein the drive rod guiding member subsequently engages the drive rod by guiding the drive rod along a length of the drive rod guiding member after the drive rod disengages from the door handle or the latch release unit.

2. The system of claim 1 wherein the drive rod guiding member guides the drive rod away from an engagement point coupled with the door handle or the latch release unit.

3. The system of claim 1 wherein the drive rod guiding member prevents the drive rod from re-engaging with the door handle or the latch release unit.

4. The system of claim 1 wherein the door includes a first panel and a second panel opposing each other and the door handle is located on the first panel and the drive rod guiding member is located on the second panel.

5. The system of claim 1 wherein the door includes a panel, and the door handle and the drive rod guiding member are located on the panel.

6. The system of claim 1 further comprising a latch unit engaged to the latch release unit, wherein the drive rod guiding member is mounted to the latch release unit.

7. The system of claim 1 further comprising:

a latch unit engaged to the latch release unit and actuated by the drive rod; and a striker selectively engaged with the latch unit based on the actuations of the drive rod, wherein the door is in a closed state when the latch unit is engaged with the striker, and the door is in an open state when the latch unit is disengaged from the striker.

8. The system of claim 7 wherein the door is in the closed state after impact to the door.

9. The system of claim 1 wherein the drive rod guiding member includes an attachment portion for attaching the drive rod guiding member to the door, and a guiding portion extending from the attachment portion in a triangular shape for guiding the drive rod.

10. An automobile comprising:

a frame;

a striker located in the frame; and a door connected to the frame and selectively engaged with the striker, the door including a latch unit selectively engaged with the striker, a latch release unit connected to the latch unit, wherein actuation of the latch release unit controls the engagement of the latch unit with the striker, a drive rod engaged to the latch release unit, a door handle engaged to the drive rod, wherein the drive rod actuates the latch release unit based on a movement of the door handle, and a drive rod guiding member disengaged from the drive rod, wherein upon impact to the door causing deformation of the door, the drive rod disengages from the door handle or the latch release unit, and wherein the drive rod guiding member subsequently engages the drive rod by sliding the drive rod along a length of the drive rod guiding member after the drive rod disengages from the door handle or the latch release unit.

11. The automobile of claim 10 wherein the drive rod guiding member guides the drive rod away from an engagement point coupled with the door handle or the latch release unit.

12. The automobile of claim 10 wherein the drive rod guiding member prevents the drive rod from re-engaging with the door handle or the latch release unit.

13. The automobile of claim 10 wherein the door includes a first panel and a second panel opposing each other, and the door handle is located on the first panel and the drive rod guiding member is located on the second panel.

14. The automobile of claim 10 wherein the door includes a panel, and the door handle and the drive rod guiding member are located on the panel.

15. The automobile of claim 10 wherein the drive rod guiding member includes an attachment portion for attaching the drive rod guiding member to the door, and a guiding portion extending from the attachment portion in a triangular shape for guiding the drive rod.

16. A method for guiding a drive rod in a door after an impact to the door comprising:

disengaging the drive rod from a door handle or a latch release unit; and subsequently guiding the drive rod along a length of a drive rod guiding member after the drive rod has disengaged from the door handle or the latch release unit.

17. The method of claim 16 wherein the step of guiding the drive rod includes guiding the drive rod away from an engagement point coupled with the door handle or the latch release unit.

18. The method of claim 16 further comprising preventing the drive rod from re-engaging with the door handle or the latch release unit.

19. The method of claim 16 further comprising maintaining the door in a closed position.

20. The method of claim 19 wherein the step of maintaining the door in a closed position includes maintaining the door in a closed position even when the door handle is actuated.

* * * * *